US007114773B2

(12) United States Patent
Ho

(10) Patent No.: US 7,114,773 B2
(45) Date of Patent: Oct. 3, 2006

(54) HAND-CARRYABLE AND DEFORMABLE STORING DEVICE WITH SEAT

(76) Inventor: Cheng I Ho, No. 13, Yong Yi Road, Tai-Ping, Taichung Hsien (TW)

( * ) Notice: Subject to any disclaimer, the term of this patent is extended or adjusted under 35 U.S.C. 154(b) by 208 days.

(21) Appl. No.: 10/933,450

(22) Filed: Sep. 3, 2004

(65) Prior Publication Data

US 2005/0200168 A1 Sep. 15, 2005

(30) Foreign Application Priority Data

Mar. 8, 2004 (TW) ..... 93203416 U

(51) Int. Cl.
*A47C 7/62* (2006.01)

(52) U.S. Cl. ..... 297/188.08; 297/129; 297/188.13

(58) Field of Classification Search ..... 297/129, 297/188.08, 188.12, 188.13, 188.2
See application file for complete search history.

(56) References Cited

U.S. PATENT DOCUMENTS 2,375,819 A * 5/1945 Reid ..... 297/188.08
3,122,397 A * 2/1964 Mintz ..... 297/188.13
4,103,965 A * 8/1978 Engman ..... 297/188.12
5,722,717 A * 3/1998 Rettenberger ..... 297/188.1
6,000,752 A * 12/1999 Shyr ..... 297/188.08
6,048,023 A * 4/2000 Lampton ..... 297/129
6,375,258 B1 * 4/2002 Fang ..... 297/188.08

* cited by examiner

*Primary Examiner*—Peter R. Brown
(74) *Attorney, Agent, or Firm*—Troxell Law Office, PLLC

(57) ABSTRACT

A hand-carryable and deformable storing device with seat is disclosed. It includes a storing body, a pair of movable frames, a seat and one connecting portion. This storing body has an openable portion that is coverable. Each of the pair of movable frames includes a pair of supporting elements, a hand-carryable portion and a locating portion. The seat has two hand-carryable potions. The storing body, the pair of movable frames, the seat and the connecting portion are connected together. It has various carrying types. It can convert into a seat. The storing body is compressible. And, it has various storing types.

8 Claims, 5 Drawing Sheets

HAND-CARRYABLE AND DEFORMABLE STORING DEVICE WITH SEAT

BACKGROUND OF INVENTION

1. Field of the Invention

The present invention relates to a storing device. Particularly, it relates to a hand-carryable and deformable storing device with seat. It has various carrying types. It can convert into a seat. The storing body is compressible. And, it has various storing types.

2. Description of the Prior Art

In the past, a worker or a builder usually needs to carry all the required tools in a traditional tool bag. This kind of bag is soft and deformable, so it can be folded after the stored tools are taken out. Also, the bag is easy to use. Alternatively, if the worker or the builder carries a traditional solid box to store them, its advantage is to classify them easier. But, no matter which one, they have the following disadvantages:

[1] The carrying type is unchanged. For the traditional tool bag, it only has a soft handle for hand-carrying. In case the entire tool bag is heavy, it will cause the user's hand injured. If one person wants to change to be carried by shoulder, it is hard to add on the original one. For the traditional solid box, there is only a small handle. When many tools are stored in this solid box, it becomes quite heavy to hold by one hand. Sometimes, it needs two hands. So, it is inconvenient.

[2] The user cannot sit on it. For the traditional soft bag, it is possible to support the user's weight. Thus, the user cannot sit on it. For the traditional solid box one, the structure is hard to support the user's weight. In addition, the height usually is too low and there are some decorating protrusions on its top surface so that the user is hard to comfortably sit on that.

[3] The storing body is compressible. Although the traditional bag can be folded into a small volume, it cannot classify the stored tools tidily. Although the traditional solid box has the classifying function, it will drop down and mess up when the solid box is turned over or hit by other object. Beside, for the working or building place, the design drawing, related documents and papers should be kept clean, But, they are not easy to be stored in the solid box to prevent unnecessary scratches by tools or objects.

Therefore, it is necessary to design a new product to overcome the above-mentioned disadvantages.

SUMMARY OF THE INVENTION

The primary object of the present invention is to provide a hand-carryable and deformable storing device with seat. In which, it has various carrying types, especially by shoulder or by hand.

The next object of the present invention is to provide a hand-carryable and deformable storing device with seat that can convert into a seat.

The other object of the present invention is to provide a hand-carryable and deformable storing device with seat. Its storing body can be slightly expanded or compressed depending on the user's need.

Another object of the present invention is to provide a hand-carryable and deformable storing device with seat. It has various storing types.

In order to achieve the above-mentioned objects, the present invention provides a technical solution. 1. A hand-carryable and deformable storing device with seat comprising:

(a) a storing body having a upper portion, a bottom portion, a left portion, a right portion, an openable portion and a sealed portion so as to enclose a space, said openable portion being coverable on said storing body and having an inner side, said openable portion and said sealed portion being substantially parallel and movable toward each other;

(b) a pair of movable frames, each movable frame including:

a pair of supporting elements substantially pivoted by two pivoting elements, said movable frames being connected with said storing body near the positions of said two pivoting elements;

a hand-carryable portion disposed on two upper ends of said supporting elements;

a locating portion disposed on two bottom ends of said supporting elements;

(c) a seat including:

a sitting portion;

a connecting part allowing said sitting to connect with an upper surface of said storing body;

a plurality of fixing portions near said hand-carryable portions so as to secure said seat on said movable frames;

a pair of recesses corresponding to said hand-carryable portions formed on said sitting portion;

(d) at least one connecting portion connecting with a bottom of said storing body and connecting said pair of moveable frames with said storing body.

DETAILED DESCRIPTION OF THE PREFERRED EMBODIMENT

Figure 1:
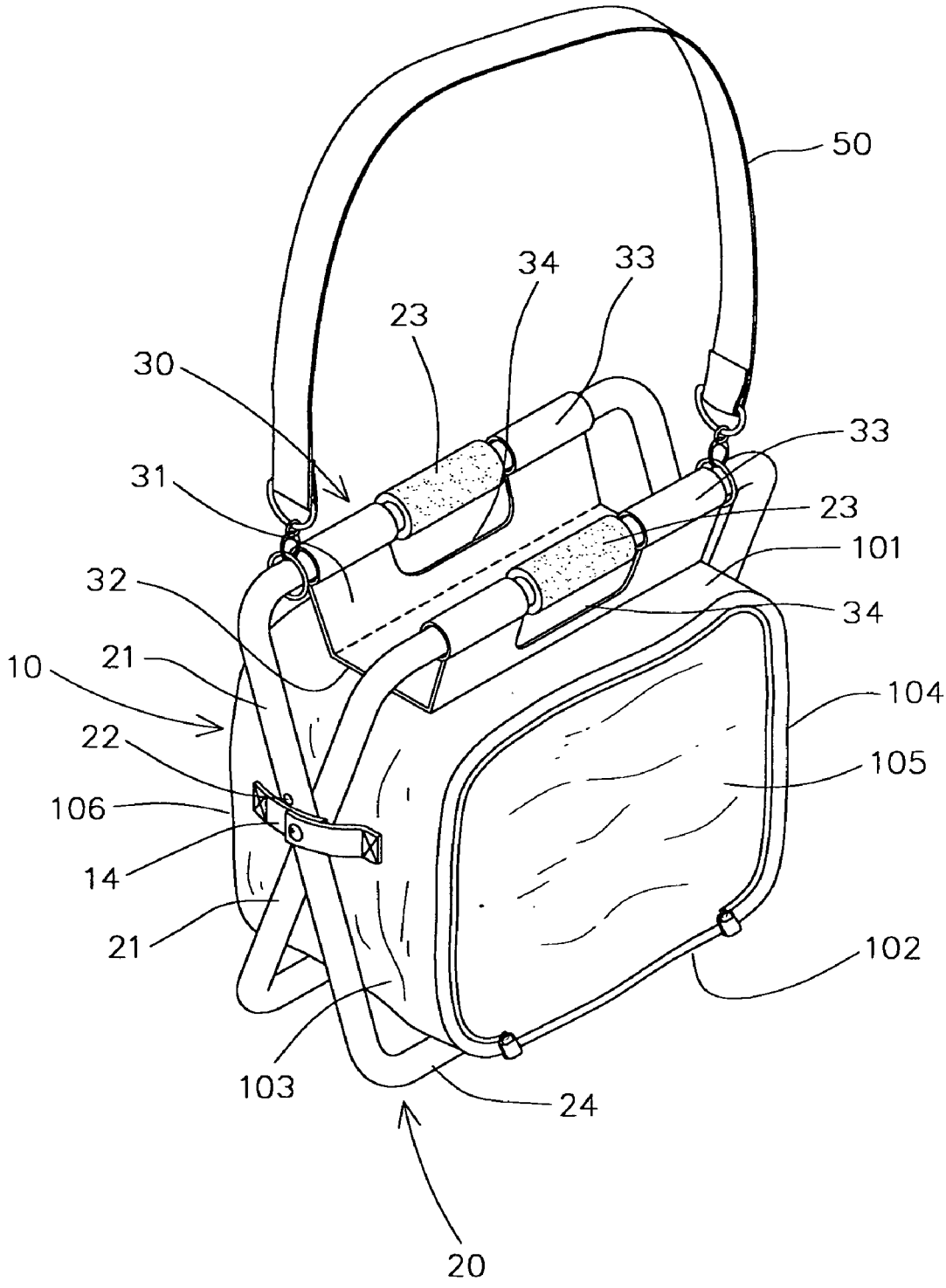
FIG. 1 is a perspective view of the first preferred embodiment of the present invention.

Referring to FIGS. 1 to 5, the present invention is a hand-carryable and deformable storing device with seat. It comprises:

(a) A storing body 10 has an upper portion 101, a bottom portion 102, a left portion 103, a right portion 104, an openable portion 105 and a sealed portion 106 so as to enclose a space. That is, the storing body 10 has a storing space. The openable portion 105 can cover or not cover on the storing body 10. This openable portion 105 has an inner side. This openable portion 105 and the sealed portion 106 are substantially parallel and movable toward each other (to minimize the size of the storing body).

The storing body 10 can further includes:

at least one first storing portion 12 being able to fixed on or detach from an inner side of the openable portion 105;

at least one deformable second storing portion 13 having a plurality of parallel receiving portions 131;

at least one first securing elements 14 disposed on the left portion 103 and the right portion 104 of the storing body 10 respectively; and at least two second securing elements 15 disposed on the bottom portion 102 of the storing body 10.

(b) A pair of movable frames 20. Each movable frame 20 includes:

a pair of supporting elements 21 substantially pivoted by two pivoting elements 22; the movable frames 20 are connected with the storing body 10 near the positions of these two pivoting elements 22;

a hand-carryable portion 23 horizontally disposed on two upper ends of the supporting elements 21; and a locating portion horizontally disposed 24 on two bottom ends of the supporting elements 21.

(c) A seat 20. It includes:

a sitting portion 31;

a connecting part 32 allowing the sitting portion 31 to connect with an upper surface of the storing body 10;

several fixing portions 33 near the hand-carryable portions 23 so as to secure the seat 20 on the movable frames 20; and a pair of recesses 34 corresponding to the hand-carryable portions 23 formed on the sitting portion 31.

(d) at least one connecting portion 40 for connecting with a bottom of the storing body 10 and connecting the pair of moveable frames 30 with the storing body 10. Furthermore, the connecting portion 40 includes:

a long strap 41 passing through the second securing elements 15 on the bottom portion 105 of the storing body 10; and two holding elements 42 disposed on two ends of the long strap 41 for connecting with two locating portions 24 of the pair of movable frames 20.

The structure of this invention is described above.

During the assembling procedure of this invention, the hand-carryable portion 23 of the pair of the movable frames 20 is inserted (or passing) through the fixing portions 33 of the sitting portion 31. So, the movable frames 20 and the seat 30 are connected. Then, the connecting parts 32 are connected with the upper portion 101 of the storing body 10. Thus, The movable frames 20, the seat 30 and the storing body 10 are connected together.

Next, by utilizing the first securing elements 14 on the left/right portions of the storing body 10, the movable frames 20 can be limited and secured on the left/right portions 103/104 of the storing body 10 near the positions of the pivoting elements 20.

The long straps 41 of the connecting portion 40 can be inserted (or passing) through the second securing elements 15 on the bottom portion 102 of the storing body 10. And, by connecting these holding elements 42 that are disposed on the ends of the long straps 41 with the locating portions 24 of the movable frames 20, the connecting portion 40, the movable frames 20 and the storing body 10 are connected together.

Figure 4:
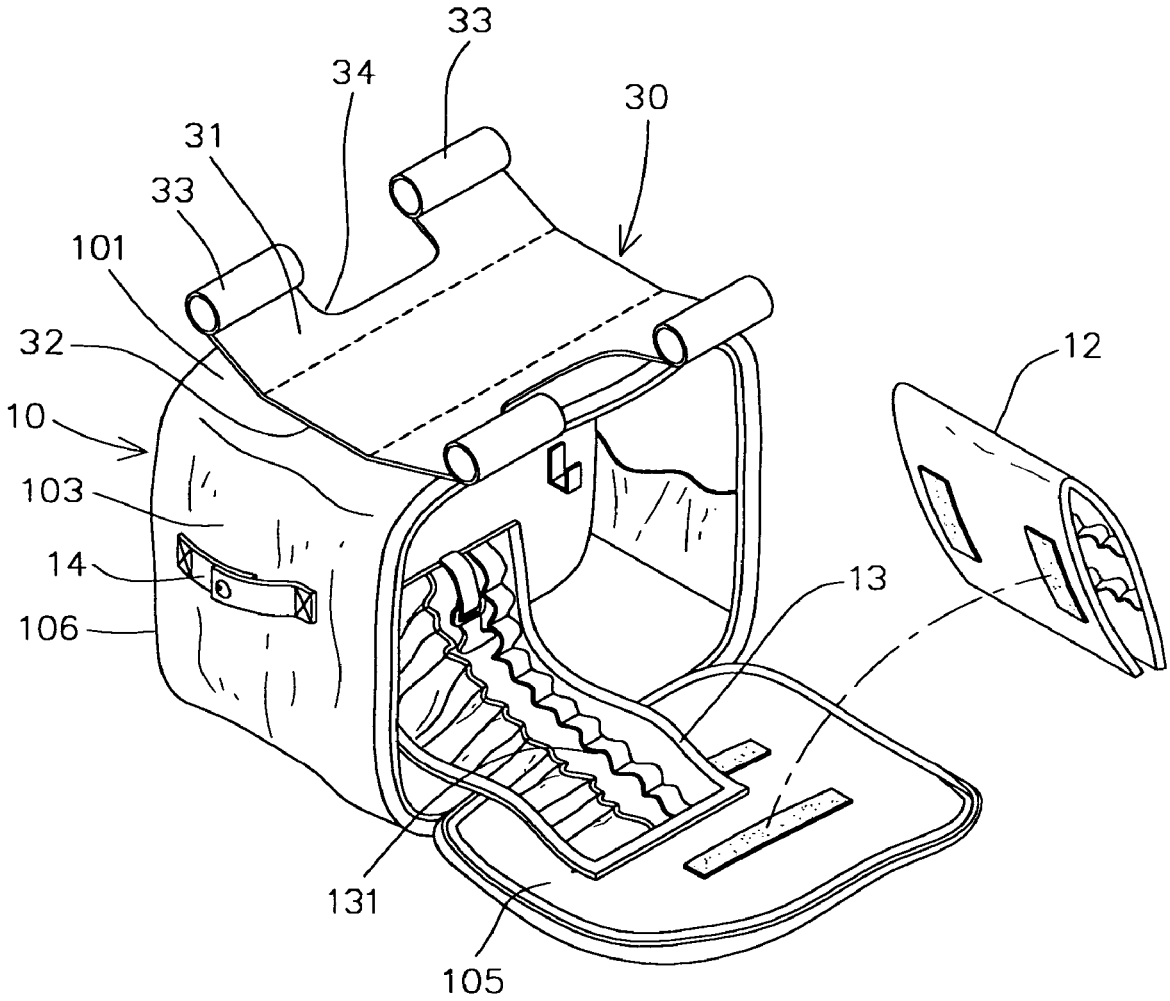
FIG. 4 is a perspective view shows the inner parts of the present invention.
Figure 5:
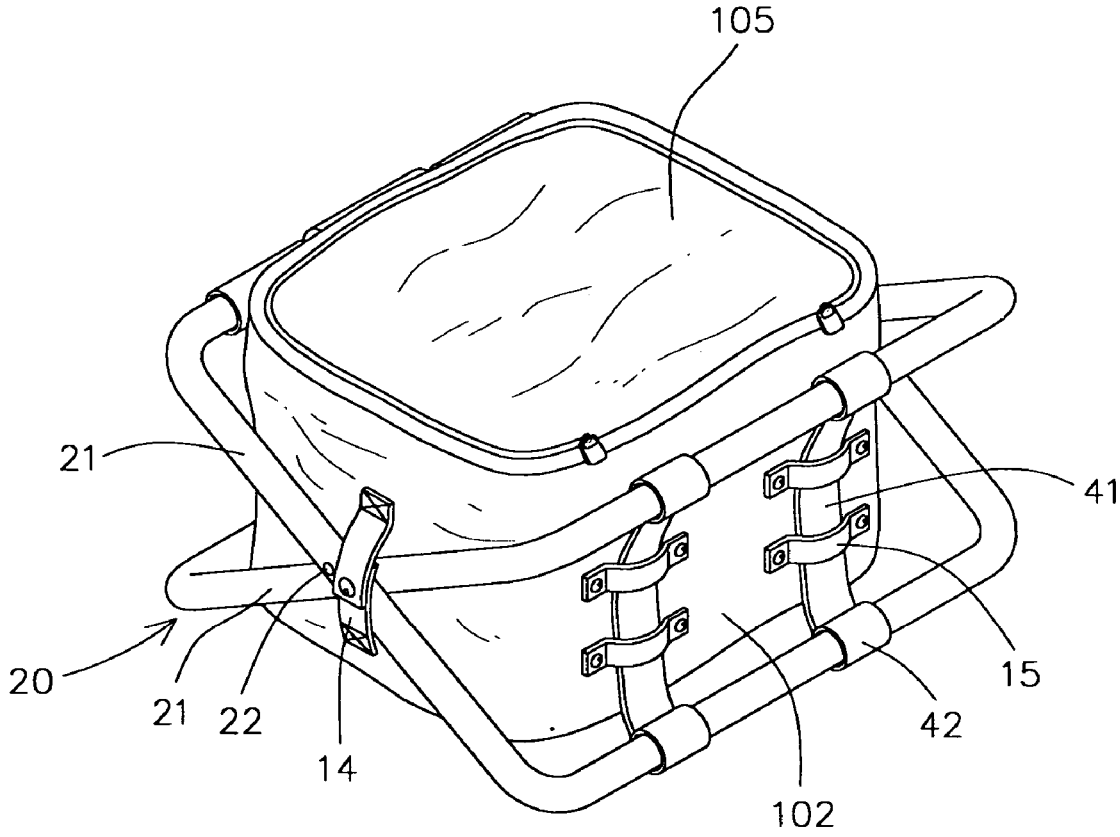
FIG. 5 is another perspective view of the present invention.

Therefore, the user can store many tools or devices into the storing body 10, such as pliers, pneumatic nailing device, screw drivers. For the user in the field of building engineering, it is possible to store some documents, map or papers that need to be kept clean. Under this condition, they can be stored in the first storing portion 12 properly. Of course, the first storing portion 12 can be completely separated from the storing body 10 (as shown in FIG. 4). Thus, it will be more convenient to carry the first storing portion 12. So, it is quite flexible in usage about this invention.

With regard to some smaller hand tools or objects, such as different screwdrivers and drills, they can be placed (and even classified) in the second storing portion 13 tidily. Therefore, once the second storing portion 13 is detached from the storing body 10, all the stored hand tools or objects are taken out, too. Especially, because all the tools and objects are stored tidily by proper classification, so a user can find the desire one quickly. Even, under a dark working environment, it will reduce the possibility for taking the wrong tool or objects.

While the user is carrying the present invention, as illustrated in FIG. 1, a shoulder strap 50 can be added and connected with the movable frames 20. By doing so, the user can use shoulder to carry the present invention.

In addition, the shoulder strap 50 is limited by the outer edges of the fixing portions 33, so it will not slide out. It is suitable for an outdoor builder who works in higher place and who needs to climb up and down. Thus, its safety will be enhanced.

Figure 2:
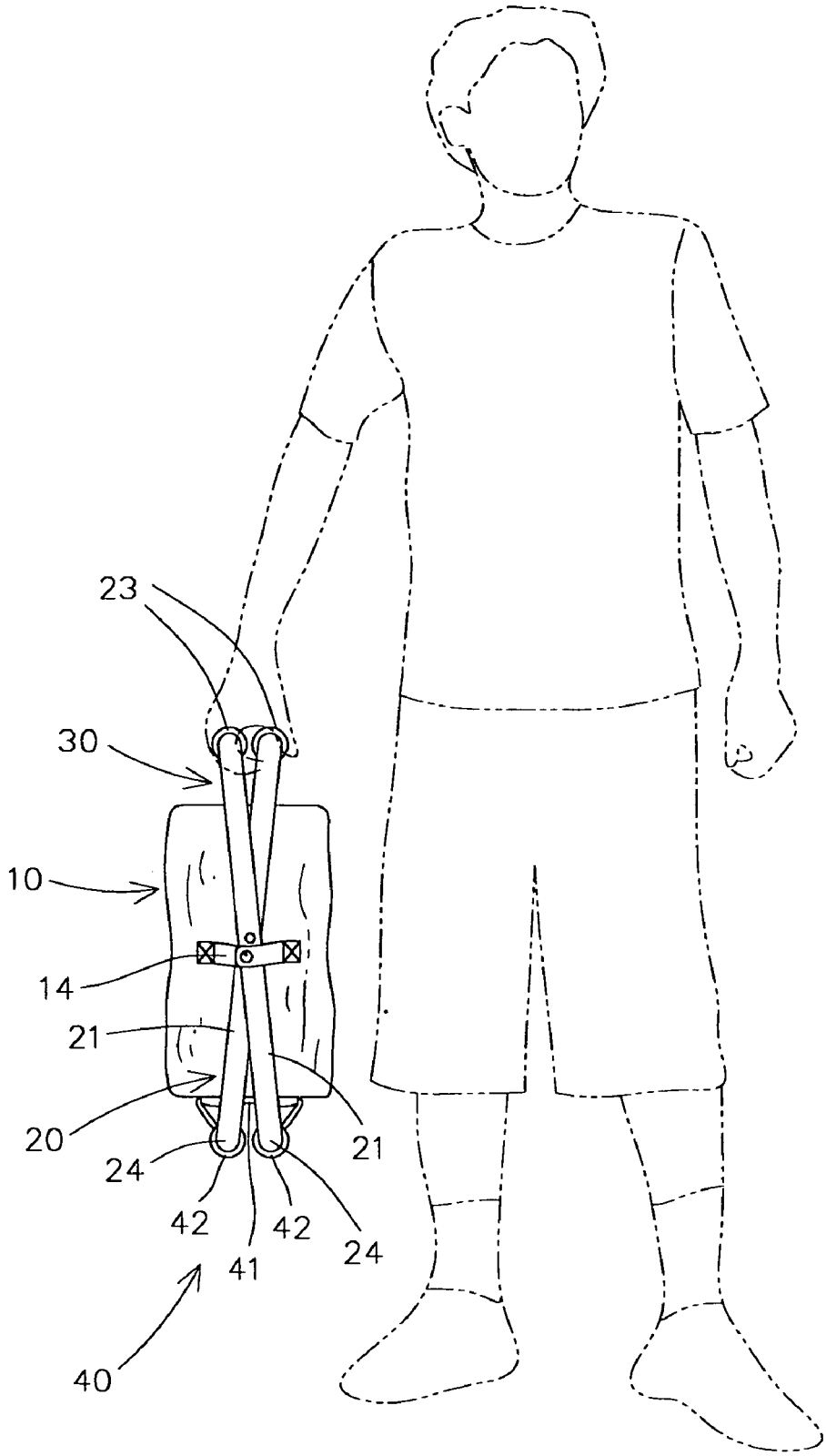
FIG. 2 shows the present invention is compressed and carried by a user.

Referring to FIG. 2, when there is only some tool or objects stored in the storing body 10, this pair of movable frames 20 can be close together. Also, these two hand-carryable portions 23 as well as the locating portions 24 will be closed accordingly. Meanwhile, the openable portion 105 and the sealed portion 106 are substantially parallel and movable toward each other so that the storing body 10 of this invention is compressed.

In addition, due to the design of the recesses 34, the user can hold the hand-carryable portions 23 through the recesses 34. So, it is easy to take and lock. Of course, even the storing body 10 is compressed, if there is a shoulder strap 50, this invention still can be carried by shoulder of the user.

Figure 3:
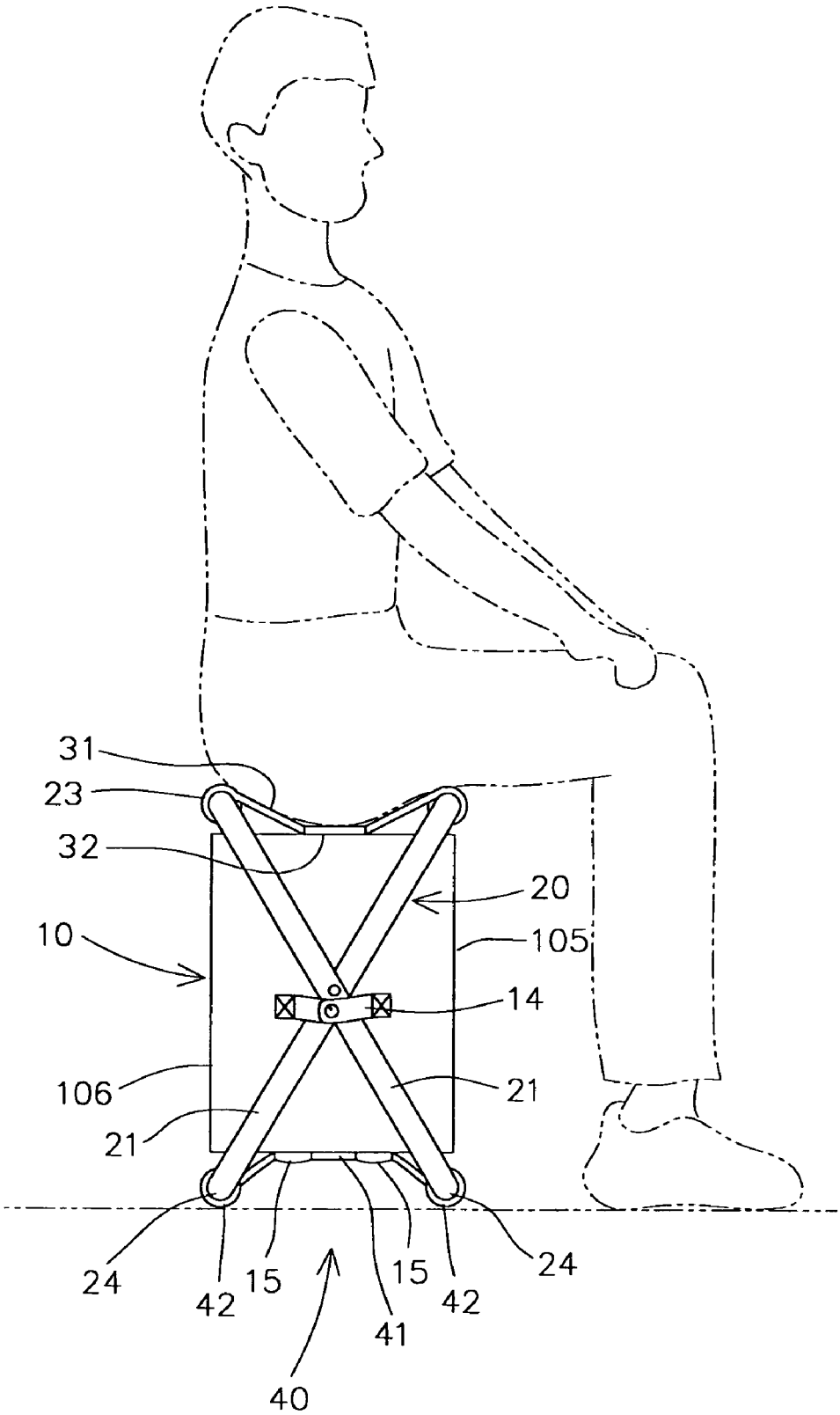
FIG. 3 shows the present invention becomes a seat for a user.

As shown in FIG. 3, the user sits on this invention. The storing body 10 and the pair of the movable frames 20 are fully expanded. These the movable frames 20 are connected with the fixing portions 33 of the seat 30. The distance between the corresponding fixing portions 33 becomes a maximum. Also, it is equal to the maximum extending distance of the hand-carryable portion 23.

Besides, because the two locating portions 24 of the movable frames 20 are connected with two holding elements 42, the largest extendable distance between the holding elements 42 (roughly equal to the length of the long strap 41) is approximately to the maximum extending distance of the locating portions 24.

Also, by mean of the design of the seat 30 and the connecting portion 40, the movement of the pair of movable frames 20 is limited. Thus, it proves a solid supporting effect for allowing a user to sit or rest thereon.

The advantages and functions of this invention can be summarized as follows:

[1] It has various carrying types. By adding the shoulder strap, this invention can be carried by the shoulder of the user. In addition, when the pair of movable frames and the storing body are compressed, the user's hand can hold on the hand-carryable portions to carry it easily.

[2] It can convert into a seat. The seat and the connecting portion are connected with the movable frames. By the limit of the extendable length of the seat and of the connection portion, after the movable frames extend (or rotate) out, the entire structure of the invention is quite strong so that the user can sit on it to rest, to work or to inspect something.

[3] The storing body is compressible. In some working places, if the required tools and objects are more, the storing body can be slightly expanded. If the required ones are fewer, the storing body can be compressed to have a smaller volume. Not only it is easy to carry, but also it is more convenient to pack in a small container or storage.

[4] It has various storing types. The present invention has a storing space for storing many tools or devices, such as pliers, pneumatic nailing device, ruler, laser level, screwdrivers. For the user in the field of building engineering, it also can store some documents, map or papers that need to be kept clean. In addition, the first storing portion can be secured inside the storing body or can be separated and taken away easily.

The above embodiments are only used to illustrate the present invention, not intended to limit the scope thereof. Many modifications of the above embodiments can be made without departing from the spirit of the present invention.

What is claimed is:

1. A hand-carryable and deformable storing device with seat comprising:

(a) a storing body having a upper portion, a bottom portion, a left portion, a right portion, an openable portion and a sealed portion so as to enclose a space, said openable portion being coverable on said storing body and having an inner side, said openable portion and said sealed portion being substantially parallel and movable toward each other;

(b) a pair of movable frames, each movable frame including:

a pair of supporting elements substantially pivoted by two pivoting elements, said movable frames being connected with said storing body near the positions of said two pivoting elements;

a hand-carryable portion disposed on two upper ends of said supporting elements;

a locating portion disposed on two bottom ends of said supporting elements;

(c) a seat including:

a sitting portion;

a connecting part allowing said sitting to connect with an upper surface of said storing body;

a plurality of fixing portions near said hand-carryable portions so as to secure said seat on said movable frames;

a pair of recesses corresponding to said hand-carryable portions formed on said sitting portion; and (d) at least one connecting portion connecting with a bottom of said storing body and connecting said pair of moveable frames with said storing body.

2. The hand-carryable and deformable storing device with seat as claimed in claim 1, wherein said storing body has a storing space.

3. The hand-carryable and deformable storing device with seat as claimed in claim 1, wherein said storing body further includes:

at least one first storing portion being able to fixed on or detach from an inner side of said openable portion.

4. The hand-carryable and deformable storing device with seat as claimed in claim 1, wherein said storing body further includes:

at least one deformable second storing portion having a plurality of parallel receiving portions.

5. The hand-carryable and deformable storing device with seat as claimed in claim 1, wherein said storing body further includes:

at least one first securing element disposed on the left portion and the right portion of said storing body respectively.

6. The hand-carryable and deformable storing device with seat as claimed in claim 5, wherein the pair of movable frames being substantially pivoted by said pivoting elements near the first securing elements.

7. The hand-carryable and deformable storing device with seat as claimed in claim 1, wherein said storing body further includes:

at least two second securing elements disposed on said bottom portion of said storing body.

8. The hand-carryable and deformable storing device with seat as claimed in claim 7, wherein said connecting portion including:

a long strap passing through said second securing elements on said bottom portion of said storing body; and two holding elements disposed on two ends of said long strap for connecting with two locating portions of said pair of movable frames.

* * * * *